US005622620A

United States Patent [19]

Meenan et al.

[11] Patent Number: 5,622,620

[45] Date of Patent: Apr. 22, 1997

[54] APPARATUS FOR TREATING FOUNTAIN SOLUTION

[75] Inventors: Sean G. Meenan, Plainview; Richard C. Stoyell, Jr., Moravia; Lawrence A. Smith, Jr., Smithtown, all of N.Y.

[73] Assignee: PALL Corporation, East Hills, N.Y.

[21] Appl. No.: 415,072

[22] Filed: Mar. 31, 1995

Related U.S. Application Data

[63] Continuation-in-part of Ser. No. 272,215, Jul. 8, 1994, Pat. No. 5,489,379.

[51] Int. Cl.[6] ..... B41F 7/24

[52] U.S. Cl. ..... 210/130; 210/167; 210/171; 210/196; 210/197; 210/242.1; 210/488; 210/493.5; 101/148; 101/363; 101/364

[58] Field of Search ..... 210/130, 167, 210/171, 194, 196, 197, 416.1, 242.1, 248, 323.2, 488, 493.5; 101/147, 148, 363, 364, 366, 367; 354/324

[56] References Cited

U.S. PATENT DOCUMENTS 4,657,040 4/1987 Torres ..... 210/130

5,124,736 6/1992 Yamamoto et al. ..... 354/325

FOREIGN PATENT DOCUMENTS 0325021 8/1988 European Pat. Off. .

2263874 2/1992 United Kingdom .

*Primary Examiner*—Robert J. Popovics

*Attorney, Agent, or Firm*—Leydig, Voit & Mayer

[57] ABSTRACT

The disclosure describes an apparatus for treating fountain solution which comprises a recirculation assembly and a microporous filter assembly. The recirculation assembly is connected between the outlet and inlet of a fountain solution tray of a printing system. The recirculation assembly includes a fountain solution sump and a return line which extends from the outlet of the fountain solution tray to the sump. The microporous filter assembly is positioned in the sump or in the return line and includes a filter position across a fountain solution flow path. A pressure sensitive device is cooperatively arranged with the filter to bypass the filter in response to a predetermined pressure differential.

20 Claims, 6 Drawing Sheets

APPARATUS FOR TREATING FOUNTAIN SOLUTION

This application is a continuation-in-part of application Ser. No. 08/272,215, filed Jul. 8, 1994 now U.S. Pat. No. 5,489,379.

FIELD OF THE INVENTION

This invention pertains to apparatus for treating fountain solutions used in printing systems. In particular, the present invention provides an apparatus for filtering fountain solution through a microporous filter assembly.

BACKGROUND OF THE INVENTION

Many printing systems, such as an offset lithographic printing system, require the use of an aqueous based composition commonly known as dampening fluid or fountain solution. In offset lithography the printing system includes a print plate, and the printing portion of the print plate is ink receptive and fountain solution repellent. Conversely, the blank portion of the print plate is fountain solution receptive and ink repellent. When the print plate contacts rollers wet with ink and rollers wet with fountain solution, the fountain solution coats the blank portion of the plate while the ink coats the image portion of the plate. Wetting the blank portion with fountain solution helps prevent printing ink from adhering to blank portions of the print plate.

Within the printing system, fountain solution is collected in one or more fountain solution reservoirs, commonly called trays. One or more rollers positioned in the tray transfers the fountain solution from the tray to a print plate. A circulation system is used to recirculate fountain solution from a fountain solution outlet of each tray to a sump and back through a fountain solution inlet to each tray of the printing system, and the fountain solution is conditioned for reuse as it is circulated. The most common means of driving the fountain solution from the fountain solution trays to the sump is by gravity feed or gravity-assisted feed, while a pump returns the fountain solution from the sump back to the fountain solution trays of the printing system. Circulation systems are available from Dahlgren USA, Inc. of Carrollton, Tex., Baldwin Dampening Systems, a Baldwin Technology Company, of Naugatuck, Conn. and Royse Manufacturing Company of Dallas, Tex.

It is well known in the printing industry that as fountain solution becomes contaminated with particulates, particularly microparticulates, the print quality deteriorates. Sharp quality print runs depend to a large degree on a relatively contaminant free fountain solution. However, contamination of fountain solution is inevitable. The most common fountain solution contaminants are microparticulates from the printing ink and print paper, as well as the ambient environment. During or after extensive print runs, the fountain solution was typically replaced, due to the buildup of microparticulate contaminants in the fountain solution.

Until recently there has been little incentive to filter fountain solution. In some instances, simple sponge filters or disposable bag filters were used, but these filters function principally to protect the sump pump from large debris. Industry followed the practice that fountain solution, being mostly water with inexpensive additives, could be replaced on a fairly regular basis.

New environmental awareness as well as stringent disposal codes, however, have created the need for a system to filter the recirculating fountain solution so that it is maintained relatively contaminant free. For example, in many localities the spent fountain solution is classified as hazardous waste. The practice of frequently discarding and replacing the solution has therefore become cost prohibitive.

Fountain solution filtration systems currently employed include sponge filters, panel filters (see U.S. Pat. No. 4,671,869) or packed beds (see U.S. Pat. No. 4,608,158). Unfortunately, these systems do not offer the degree of filtration needed to prolong the life of fountain solution from days to several weeks. Furthermore, panel filters and packed beds require special housings and fittings and require significant down time for replacement. The special housings and fittings represent expensive capital costs relative to the profit margins present in printing operations.

There is a need then for a filter system that effectively removes microparticulate contaminants from recirculating fountain solution, preferably a system that can be placed in line with minimal additional hardware or housings. Furthermore, there is a need for a filter system that exhibits a high removal rating for microparticulates, has a long life, and is designed to operate under gravity feed or gravity-assisted feed conditions.

SUMMARY OF THE INVENTION

In accordance with one aspect of the invention, methods and apparatus are provided for treating fountain solution which recirculates between the fountain solution outlet and the fountain solution inlet of the trays of a printing system.

Accordingly, the present invention provides an apparatus for treating fountain solution which comprises a recirculation assembly, a microporous filter assembly and a pressure sensitive device. The recirculation assembly may be connected between the outlet of the fountain solution tray and inlet of the fountain solution tray of the printing system and operates to circulate fountain solution from the outlet of the fountain solution tray through the recirculation assembly to the inlet of the fountain solution tray of the printing system. The recirculation assembly includes a fountain solution sump and a return line which extends from the outlet of the fountain solution tray to the sump. The microporous filter assembly is positioned in the sump of the recirculation assembly or in the return line between the outlet of the fountain solution tray and the sump. The microporous filter assembly includes a filter element positioned across a fountain solution flow path. The filter element has a removal rating of at least about 99.98% at about 40μ and a clean pressure drop equal to or less than about 0.10 PSI/GPM per ten-inch cartridge. The pressure sensitive device is cooperatively arranged with the filter to bypass the filter in response to a predetermined pressure differential.

The present invention also provides a method for treating fountain solution comprising directing the fountain solution from the outlet of the fountain solution tray along a fountain solution return line to a fountain solution sump. The method further includes filtering the fountain solution along the return line or within the sump by directing the fountain solution through a microporous filter assembly which includes a filter positioned across a fountain solution flow path. In addition, the method includes directing the fountain solution into the sump without filtering the fountain solution when the pressure differential across the microporous filter assembly exceeds a predetermined value. Further, the method comprises returning the fountain solution from the sump to the inlet of the fountain solution tray of the printing system.

The present invention presents an advantage in that the pressure sensitive device allows the fountain solution to bypass the filter assembly and flow into the sump, thus reducing the likelihood that the fountain solution tray will overflow.

DETAILED DESCRIPTION OF EXEMPLARY EMBODIMENT

Figure 1:
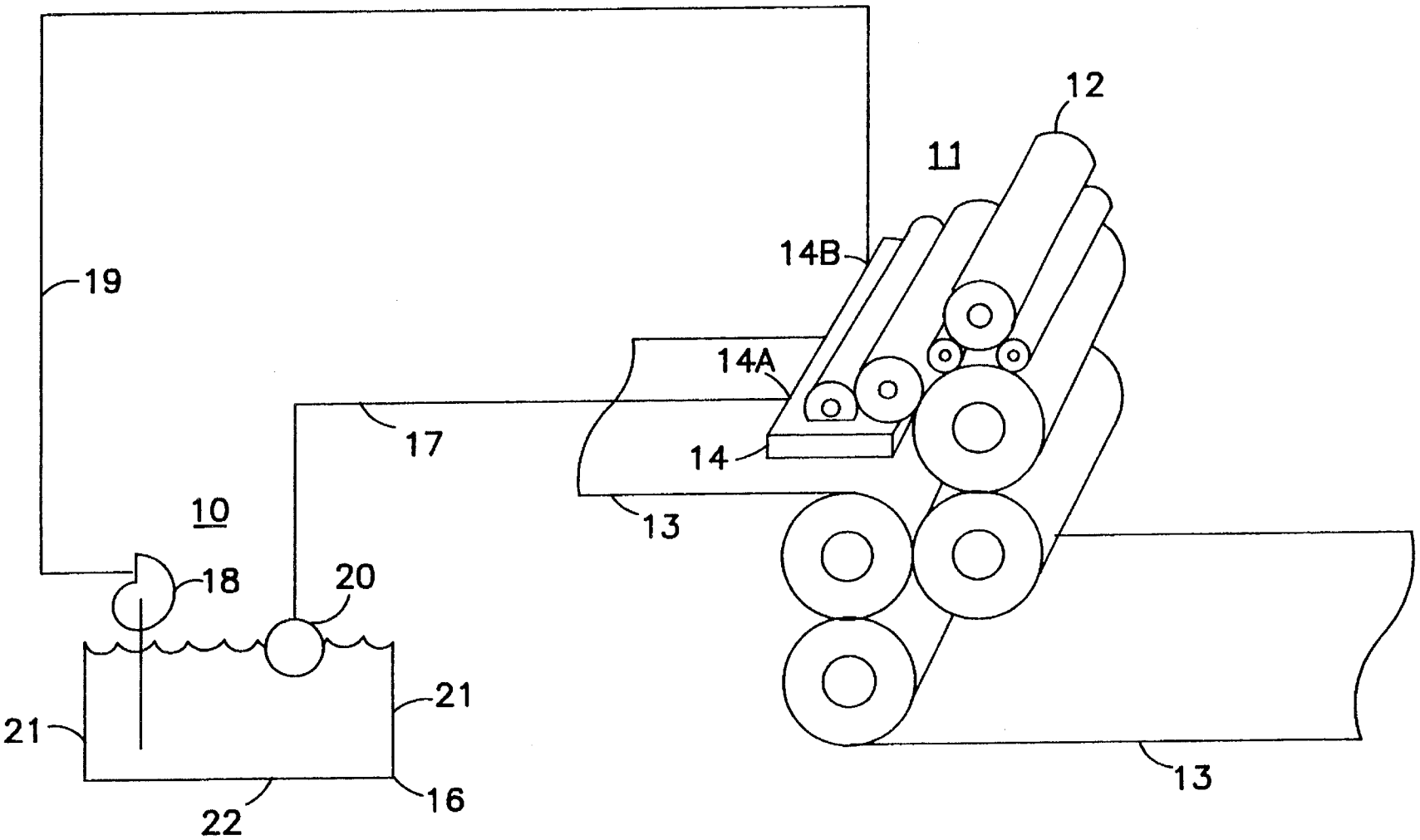
FIG. 1 depicts a printing system including a partial schematic diagram of a fountain solution treating apparatus embodying the present invention.

As shown in FIG. 1, one example of an embodiment of the present invention generally comprises a recirculation assembly 10 connected to a printing system 11. Printing systems are well known in the art and typically comprise various rollers 12 for transferring an image onto paper 13. Fountain solution utilized in the printing process is collected in one or more fountain solution reservoirs 14, commonly known as fountain solution trays, and at least one roller 12 is positioned in each tray 14 and is used to transfer the fountain solution to a print plate.

The recirculation assembly 10 serves to recirculate the fountain solution between an outlet 14A and an inlet 14B associated with the trays 14 of the printing system 11 and to treat the fountain solution for continued use within the printing system 11. The recirculation assembly 10 may include a fountain solution reservoir 16, such as a sump, and a return line 17 extending from the outlet 14A of one or more trays 14 of the printing system 11 to the sump 16. Various drive mechanisms may be used to direct the fountain solution from the outlet 14A of the trays 14 along the return line 17 to the sump 16. In one embodiment, the drive mechanism is no more than a gravity feed established between the outlet 14A of the trays 14 and the sump 16. For example, the sump 16 may be located as much as about 5 feet or more below the trays 14, preferably about 2 to 3 feet or less. In another embodiment, the drive mechanism may be a gravity-assisted feed, for example, a gravity feed assisted by a vacuum return jet (not shown). In a further embodiment, a pump (not shown) may be coupled in the return line 17 and used to drive the fountain solution from the outlet 14A of the trays 14 to the sump 16. In any of these embodiments, a pump 18 located in the sump 16 may be used to pump the fountain solution from the sump 16 along a feed line 19 to the inlet 14B associated with the trays 14 of the printing system 11. In one embodiment, the inlet 14B simply comprises an open portion of the tray 14 and the feed line 19 feeds the fountain solution through the open portion into the tray 14.

To treat the fountain solution for reuse, the recirculation assembly may include a cooling unit (not shown) coupled to the sump 16 to lower the temperature of the fountain solution coming from the printing system 11. The fountain solution is typically warmed by the rollers 12 and it is often preferable to cool the fountain solution before it is returned to the printing system 11.

In accordance with one aspect of the invention, a filter assembly 20 is positioned across a fountain solution flow path in the return line 17 leading to the sump 16 or in the sump 16, and the fountain solution entering or contained in the sump 16 is treated for reuse by directing the fountain solution through the filter assembly 20 and removing microparticulates from the fountain solution. The filter assembly 20 may be inserted anywhere along the return line 17. Alternatively, the filter assembly may be positioned in the sump 16, for example, at the inlet to the pump 18. Preferably, the filter assembly is positioned at the end of the return line 17 so fountain solution from the printing system 11 flows along the return line 17, through the filter assembly 20, and into the sump 16. Most preferably, the return line 17 is a flexible conduit, and the filter assembly 20 is attached to the end of the flexible conduit and is free to float on the surface or sink below the surface of the fountain solution in the sump 16. Alternatively, the filter assembly 20 may be fixedly mounted above the surface of the fountain solution in the sump 16 or below the surface of the fountain solution in the sump 16, for example, along the walls 21 or the base 22 of the sump 16.

The filter assembly may be configured in a wide variety of ways. For example, the filter assembly may include a housing comprising an impervious body having an inlet and an outlet and a filter element positioned in the impervious body between the inlet and the outlet. The filter element may be in the form of a flat disk or a solid cylinder, where the inlet of the housing communicates with one end face of the filter element while the outlet of the housing communicates with the other end face of the filter element. Alternatively, the filter element may be in the form of a hollow cylinder, where the inlet and the outlet of the housing respectively, communicate with the exterior and the interior, or the interior and the exterior, of the filter element.

Figure 2:
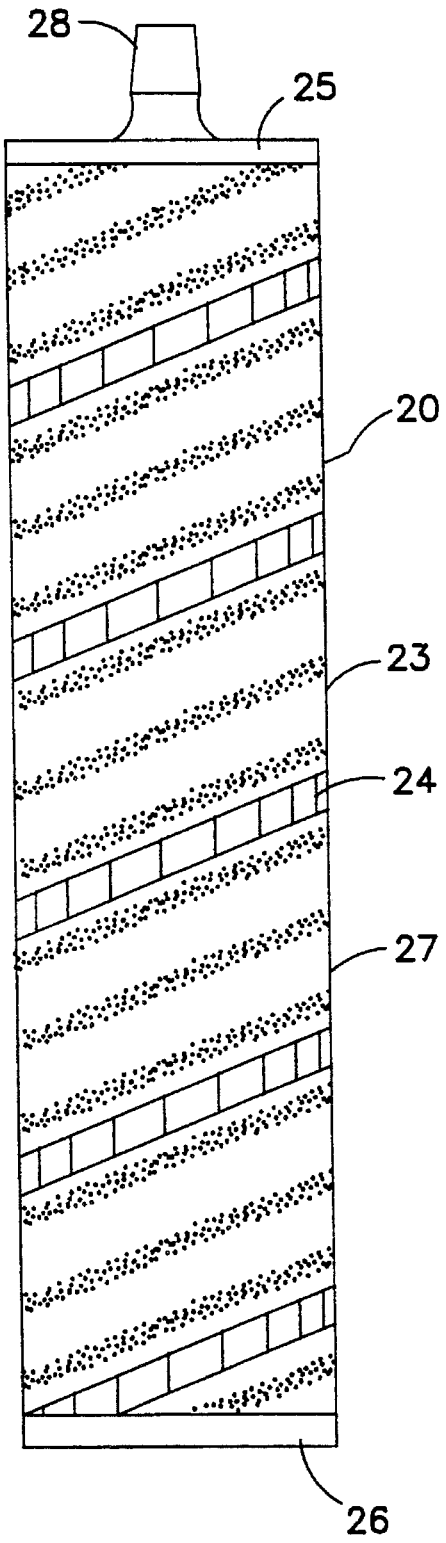
FIG. 2 is a side view showing a filter element of the apparatus depicted in FIG. 1.

Preferably, the filter assembly comprises one or more hollow filter cartridges. The filter cartridge can be variously configured, as disclosed, for example, in U.S. Pat. No. 5,252,207 and International Publication No. WO 94/11082, both of which are incorporated by reference. As shown in FIG. 2, the filter cartridge 23 may generally comprise a filter element 24 extending between and bonded to first and second end caps 25, 26, preferably an open end cap 25 and a blind end cap 26. The filter cartridge 23 may further include a wrap 27 wound around the outer periphery of the filter element 24. A perforated core (not shown) and/or a perforated cage (not shown) may extend between the end caps 25, 26 along the inner and outer peripheries, respectively, of the filter element 24 to provide additional structural support to the filter cartridge 23.

In a particularly preferred embodiment of the invention, the open end cap 25 of the filter cartridge 23 includes a connector 28, such as a hose barb. The end of the return line 17 is attached to the open end cap 25 at the hose barb connecter 28 and the filter cartridge 23 is positioned directly in the sump 16, for example, where it floats on the surface or sinks below the surface of the fountain solution. Fountain solution contaminated with microparticulates is directed from the printing system 11 along the return line 17 through the open end cap 25 into the interior of the filter cartridge 23.

From the interior of the filter cartridge 23, the fountain solution flows inside out through the filter element 24, where the microparticulates are removed. In this embodiment, there is no impervious housing structure between the filter element 24 and the walls 22 of the sump 16, so the fountain solution flows through the filter element 24 directly into the fountain solution in the sump 16. This embodiment is particularly advantageous because it eliminates the need for a filter housing and any special hardware, such as a removable cover, associated with a filter housing. Not only does this significantly reduce capital costs, but it speeds change-out of the filter cartridge 23 once the filter element 24 fouls.

In accordance with another aspect of the invention, the filter assembly preferably has a low resistance to flow of fountain solution through the filter assembly. One of the most reliable, and least expensive, mechanisms for driving the fountain solution from the fountain solution trays 14 of the printing system 11 to the sump 16 is a simple gravity feed. This minimizes the hardware necessary to drive the fountain solution into the sump 16, but it provides a relatively small force for establishing a suitable fountain solution flow rate from the trays 14 into the sump 16. Suitable flow rates may be as much as about 15 GPM or more, although flow rates of about 3 GPM or less, e.g., about 1.5 GPM or less, are also suitable. To ensure that a gravity feed provides a suitable flow rate, the flow resistance of the filter assembly is preferably very low.

Figure 7:
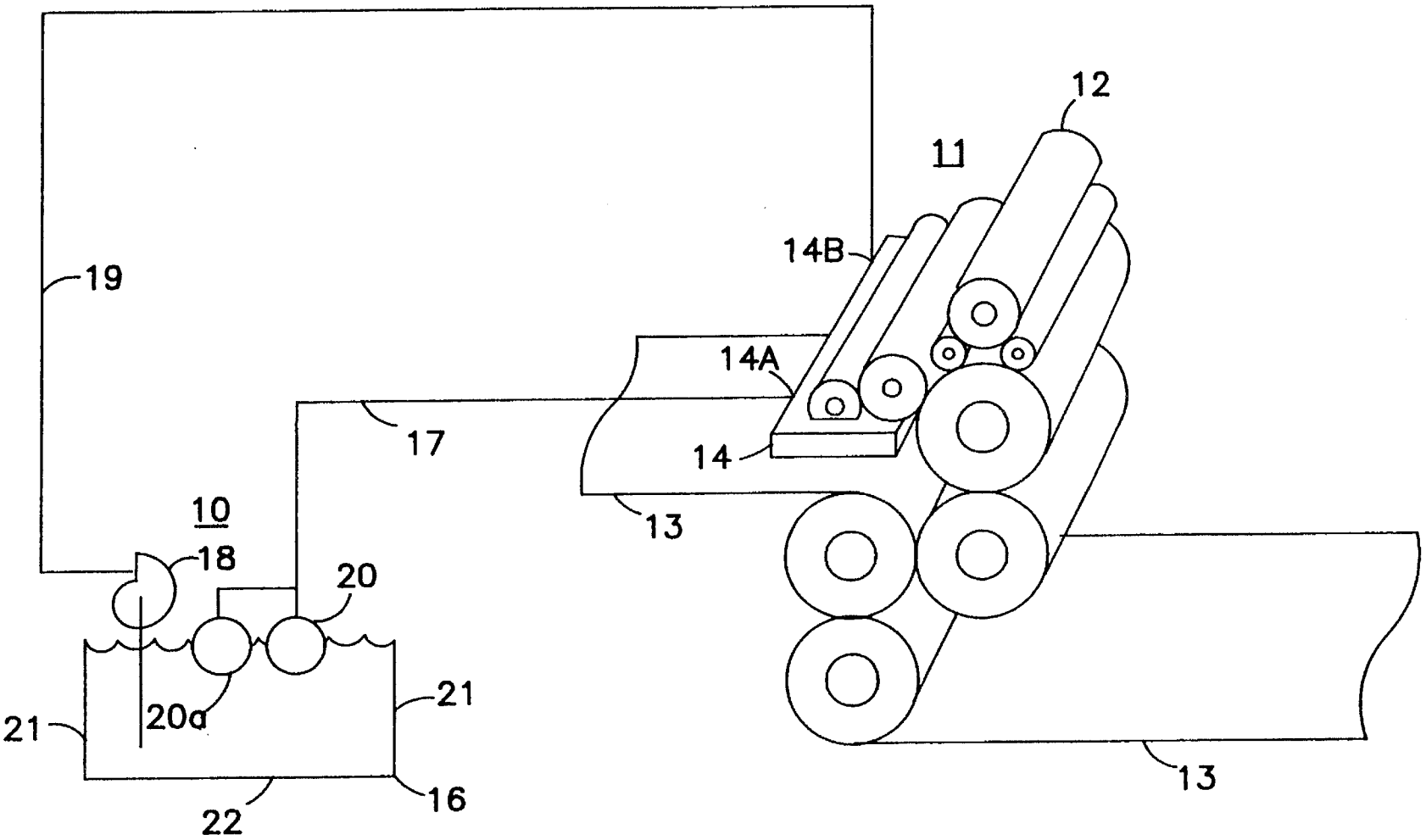
FIG. 7 depicts an apparatus for treating fountain solution according to another embodiment of the invention.

One measure of flow resistance commonly used in the industry is the clean pressure drop in PSI/GPM for a ten inch filter cartridge. A microporous filter cartridge used in the present invention preferably has a clean pressure drop no greater than about 0.10 PSI/GPM per ten inch cartridge. More preferably, the clean pressure drop is less than or equal to about 0.05 PSI/GPM per ten inch cartridge and, most preferably, less than or equal to about 0.03 PSI/GPM per ten inch cartridge, e.g., about 0.025 PSI/GPM or less per ten inch cartridge. By using a microporous filter cartridge with such a low resistance to fountain solution flow, an adequate flow rate between the trays and the sump may easily be established using only a gravity feed or a gravity assisted feed. In other embodiments of the invention, the resistance to flow could be lowered by joining two or more filter cartridges in parallel, as shown in FIG. 7 with filter cartridges 20 and 20*a*. Alternatively, a pump may be used to drive the fountain solution from the trays to the sump. However, both of these alternative embodiments involve additional hardware and further complexity and, therefore, are less desirable than a filter assembly which consists of a single microporous filter cartridge having a low flow resistance.

A wide variety of filter elements are suitable for use with the present invention. For example, the filter element may include a filtration medium comprising a porous film or membrane; a porous fibrous structure, such as a non-woven web, a fibrous sheet or a fibrous mass; and/or a porous woven structure such as a woven web or screen. Further, the filtration medium may have a uniform or graded pore structure and may comprise one or more layers, each having the same or different filtering characteristics. In addition to a filtration medium, the filter element may further include additional components such as a support and drainage material and/or a cushioning material disposed between the support and drainage material and the filtration medium. The filter element may be pleated or non-pleated.

In accordance with a further aspect of the invention, the filter element is microporous. For example, the filter element may have a removal rating in a single pass of at least about 99.98% at about 40 microns in accordance with the modified Oklahoma State University F-2 Test Procedure discussed, for example, in U.S. Pat. No. 4,925,572. Preferably, the filter element has a removal rating of at least about 99.98% at about 20 microns. A removal rating of 99.98% at 20 microns is approximately equivalent to a removal rating of about 90% at about 11 microns. More preferably, the filter element has a removal rating in a single pass of at least about 99.98% at about 10 microns, which is approximately equivalent to a removal rating of about 90% at about 4–6 microns. A microporous filter element having a removal rating of about 99.98% at about 10 microns yields clearly superior results. It has been discovered that if the fountain solution is kept relatively free from particles as small as about 10 micrometers to about 1 micrometer, the fountain solution continues for an extended period of time to wet only the blank portion of the print plate, ensuring a crisp print image.

Figure 5:
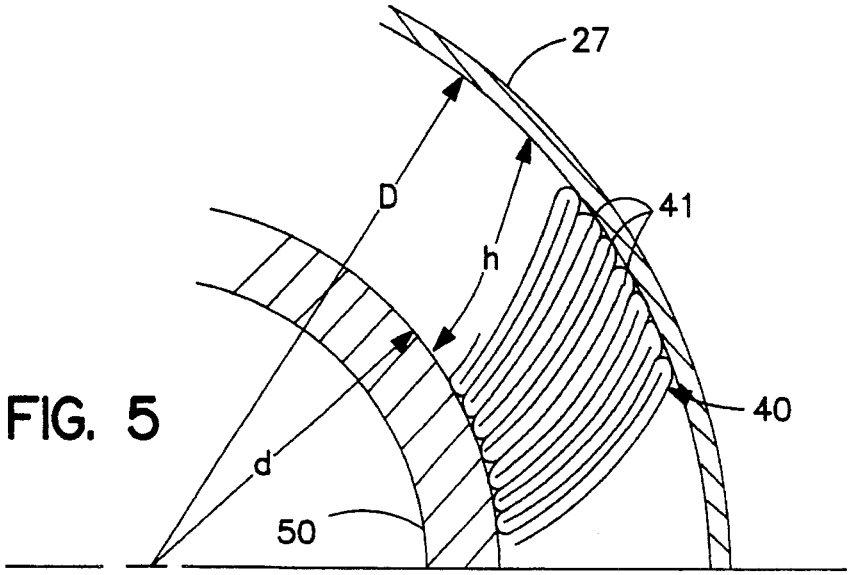
FIG. 5 is an enlarged cross sectional view of a portion of the filter of FIG. 2.
Figure 6:
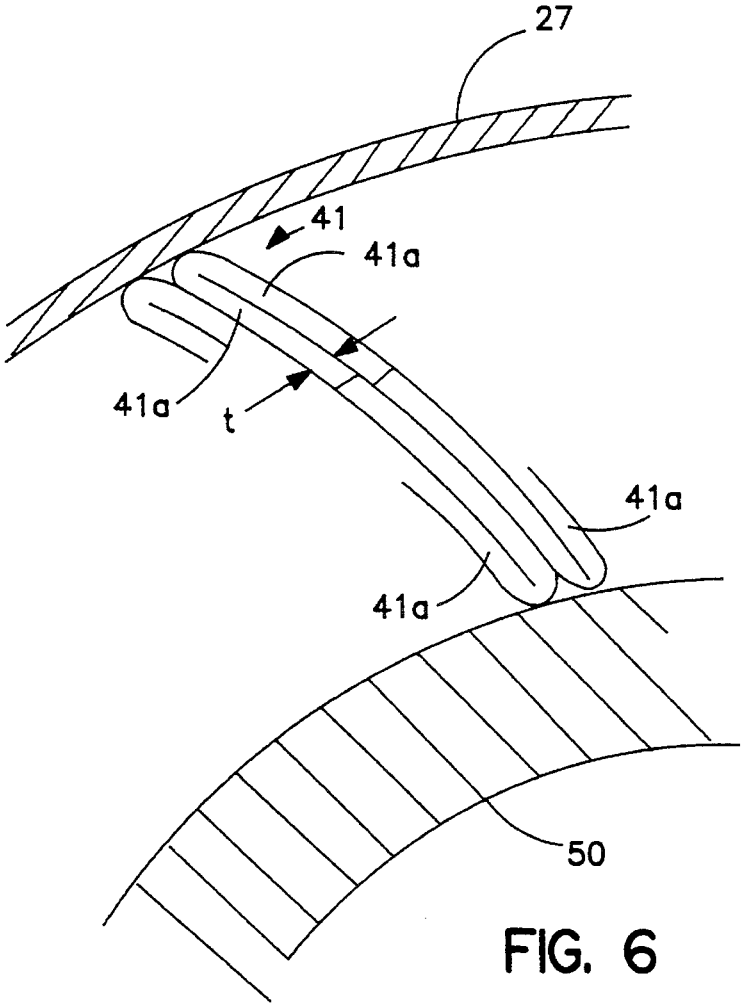
FIG. 6 illustrates an enlarged cross sectional view of one of the pleats of FIG. 5.

In a preferred embodiment, the filter element comprises a cylindrical, pleated, multi-layer structure including an inner upstream support and drainage material, such as a polymeric mesh; a filtration medium comprising upstream and downstream melt blown, non-woven, polypropylene webs having removal ratings of about 99.98% at 20 microns and 10 microns, respectively; and an outer downstream support and drainage layer also comprising an extruded polymeric mesh. The filter element is configured in a laid-over pleat arrangement and is helically wrapped with a porous non-woven polymeric web which is bonded to the filter element, as disclosed in International Publication No. WO 94/11082 and depicted in FIGS. 5 and 6. FIGS. 5 and 6 depict a cross sectional view of pleats 41, core 50, and wrap 27. The condition illustrated in FIGS. 5 and 6 in which the surfaces of the legs 41*a* of the pleats 41 are in intimate contact and in which the height H of each pleat 41 is greater than the distance between the inner and outer peripheries of the filter element 40 (i.e., [D-d]/2) is referred to as a laid-over state. In the laid-over state, pleats may extend, for example, in an arcuate or angled fashion or in a straight, non-radial direction, and there may be substantially no empty space between adjacent pleats, and virtually all of the volume between the inner and outer peripheries of the filter element 40 may be occupied by the filter element 40 and can be effectively used for filtration.

The opposing surfaces of adjoining legs 41*a* of the pleats need not be intimate contact over the entire axial length of the filter element 24, but the greater the length in the axial direction of the region of intimate contact, the more effectively used is the space between the inner and outer periphery of the filter element 24. Therefore, adjoining legs 11*a* are in intimate contact over a continuous region which preferably extends for at least approximately 50 percent, more preferably at least approximately 75 percent, and most preferably approximately 95 to 100 percent of the axial length of the filter element 24. The filter element, having a pleat height of about 0.83 inches and an outer diameter of about 2.5 inches, is formed around a perforated core having an outer diameter of about 1.3 inches. The opposite ends of the filter element and the core are bonded to polymeric ends caps, as shown in FIG. 2, to form the filter cartridge.

This preferred filter cartridge is particularly advantageous because it combines a very fine removal rating, i.e., about 99.98% at 10 microns, with a very low flow resistance, i.e., a clean pressure drop of about 0.03 PSI/GPM per 10 inch cartridge. For many filter assemblies, the resistance to flow through the filter increases with the fineness of the filter. Consequently, to obtain a filter assembly having a low flow resistance, the filter may be relatively coarse. However, the preferred filter cartridge provides both a fine removal rating and a low flow resistance, so it may be very effectively used to filter microparticulates from fountain solution, even at low driving pressures. For example, five gallons per minute of fountain solution were recirculated by a recirculation assembly from two fountain solution trays of a six-color sheet feed press through the preferred filter cartridge to a sump and then returned to the press. The conductivity of fresh, new fountain solution is typically between 1,000 and 1,400 micro mhos, where the conductivity of the fountain solution is a conventional measure of its suitability. After two weeks of circulating the fountain through the preferred filter cartridge, the conductivity of the fountain solution increased only to about 2,000 micro mhos. When the fountain solution was recirculated through the press without a microporous filter element, the fountain solution was discarded once a week when the conductivity of the fountain solution was in the range from about 2,500 to 3,000 micro mhos.

After prolonged use, the filter cartridge 23 may become fouled with particulates. Fouling of the filter cartridge 23 causes the pressure differential across the filter cartridge 23 to increase thus restricting flow of the fountain solution into the sump 16. In the case where the recirculation assembly employs a gravity feed drive mechanism, even slight pressure differentials can cause significant flow restriction of the fountain solution and generate back pressure in the return line 17. When a sufficient amount of back pressure is generated, the tray 14 may overflow and the various elements of the printing system may be flooded.

Figure 3:
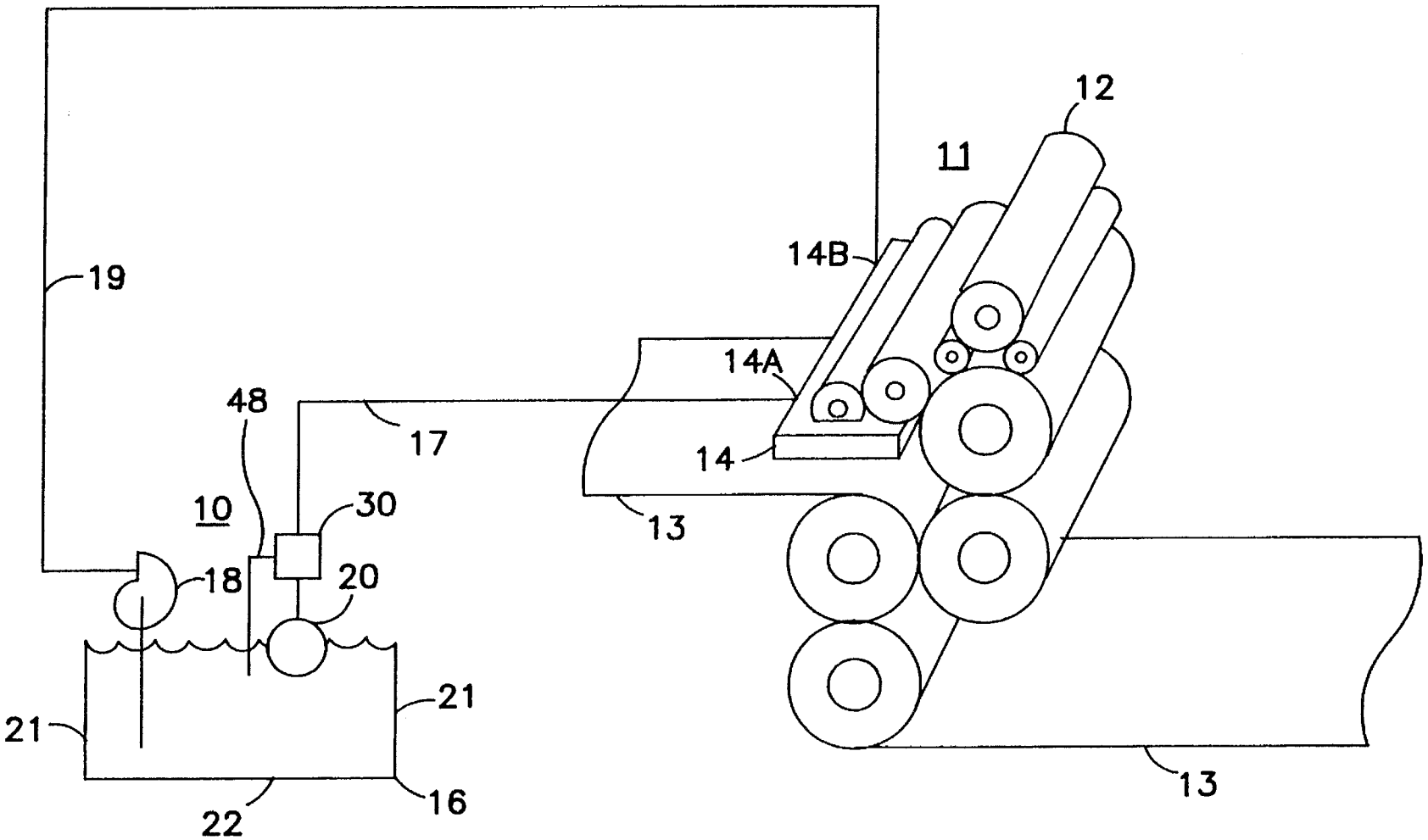
FIG. 3 depicts a printing system including a partial schematic diagram of a fountain solution treating apparatus according to another embodiment of the invention.
Figure 4:
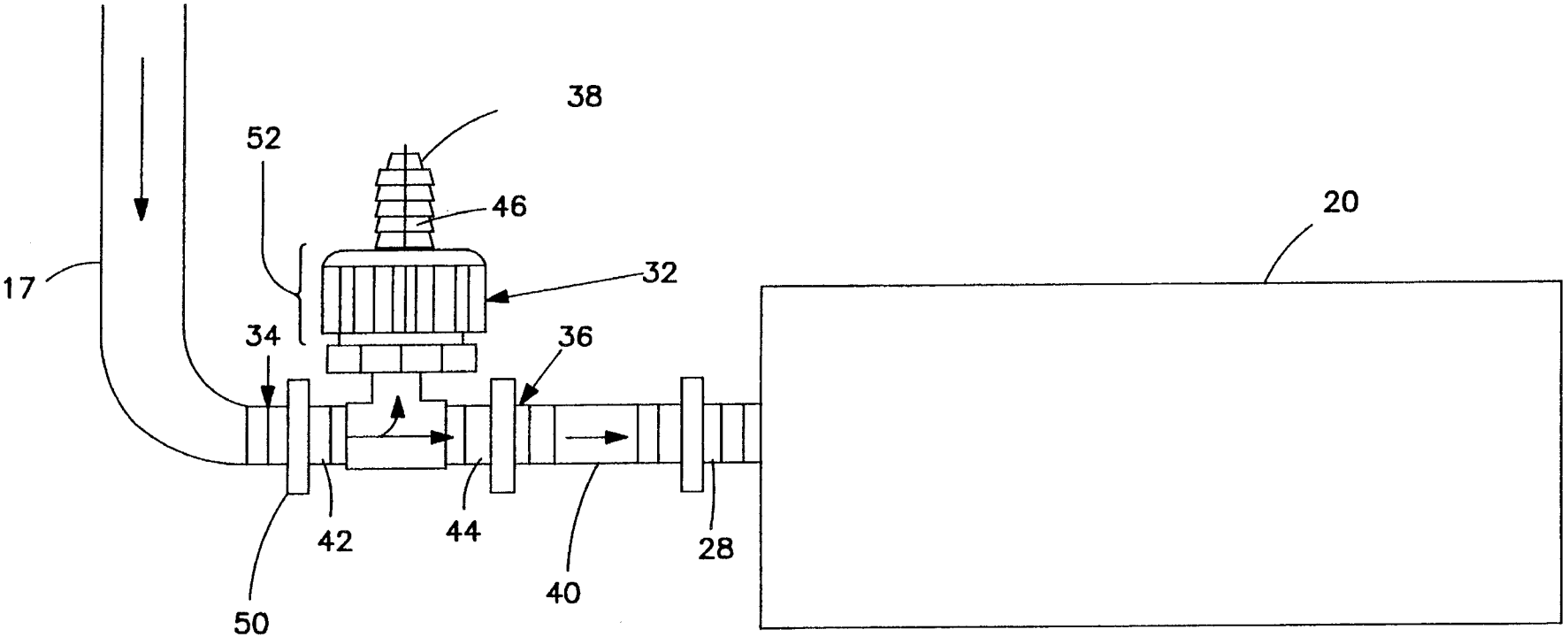
FIG. 4 illustrates a portion of the embodiment of the present invention depicted in FIG. 3.

FIGS. 3 and 4 depict yet another embodiment of the invention. To avoid overflow of the tray 14, a pressure sensitive device 30 may be disposed in the return line 17 proximate to the filter assembly 20. The pressure sensitive device 30 allows the fountain solution to bypass the filter assembly 20 and flow into the sump 16, thus reducing the likelihood that the tray 14 will overflow. Preferably, the pressure sensitive device 30 is closely coupled to the filter assembly 20 so that the pressure sensitive device 30 and the filter assembly 20 can be easily fit into the sump 16. Alternatively, the pressure sensitive 30 may be located outside of the sump 16. However, this alternative is less preferred as it may require additional coupling piping between the pressure sensitive device 30 and the sump 16.

The pressure sensitive device 30 may include any device or series of devices that divert the flow of the fountain solution when the pressure differential across the pressure sensitive device 30 exceeds a predetermined value. The pressure sensitive device 30 may be a low cost, simple, reliable device such as a bypass valve 32. In a preferred embodiment, the bypass valve 32 diverts the flow of fountain solution into the sump 16 when the pressure differential across the bypass valve 32 exceeds about 0.25 psid. More preferably, the bypass valve 32 diverts the flow of fountain solution into the sump 16 when the pressure differential across the bypass valve 32 exceeds a value within the range between about 0.25 psid and about 4 psid, even more preferably between about 0.5 psid and about 3 psid. Most preferably, the bypass valve 32 diverts the flow of fountain solution into the sump 16 when the differential pressure across the bypass valve 32 exceeds about 1.5 psid. A suitable bypass valve is available from Aerodyne Controls Corporation of Ronkonkoma, N.Y., and is designated by part number 7935-1-100.

In a preferred embodiment, the pressure differentiaL required to activate the bypass valve 32 may be slightly less than the pressure available from the drive mechanism. If the pressure differential required to activate the bypass valve 32 is lower than the pressure required to drive fluid through the filter assembly 20, the bypass valve 32 will be activated prematurely, i.e., before the filter cartridge 23 is fouled. Premature activation of the bypass valve 32 is disfavored as it under utilizes the filter cartridge 23 and may cause unfiltered fountain solution to be directed into the sump 16 unnecessarily. Therefore, an especially preferred pressure differential to open bypass valve 32 may be slightly lower than the pressure available from the drive mechanism to obtain increased life of the filter cartridge 23.

The bypass valve 32 may be variously configured. A preferred bypass valve 32 is depicted in FIG. 4. An inlet 34 and first and second outlets 36 and 38 preferably form a T shaped structure. A valve assembly including a housing 52 and a spring actuated valve mechanism (not shown) may be positioned between the inlet 34 and the second outlet 38. The inlet 34 may be coupled to the return line 17, the first outlet 36 may be coupled to the filter assembly 20, and the second outlet 38 may be in fluid communication with the sump 16. When the bypass valve 32 is not activated, the fountain solution flows directly through the inlet 34 and the first outlet 36 to the filter assembly 20. However, when the pressure differential across the bypass valve 32, i.e., between the inlet 34 and the second outlet 38 exceeds the predetermined value, for example, due to the rise in pressure differential across the filter assembly 20, the bypass valve 32 may be forced open. The fountain solution then flows through the second outlet 38 into the sump 16 until the pressure differential between the inlet 34 and the second outlet 38 falls below the predetermined value 32. The second outlet 38 may be coupled with an outlet conduit (not shown) that either floats along the surface or is submerged below the surface of the fountain solution, and the outlet conduit may be rigid but is preferably flexible. However, the second outlet 38 is preferably free from additional structure and the bypassed fountain solution may simply be driven from the second outlet 38 directly into the sump 16 by the pressure differential available from the drive mechanism.

In a particularly preferred embodiment of the invention, the inlet 34 and the first and second outlets 36 and 38 of the bypass valve 32 include connectors such as hose barbs 42, 44 and 46. One end of return line 17 may be fit over hose barb 42 of the inlet 34. Likewise, one end of the conduit 40 may be fit over hose barb 44 of the first outlet 36 and the other end may be fit over the hose barb 28 of the filter cartridge 23. Preferably, the coupling space, i.e., the space between the hose barb 44 of the bypass valve 32 and the hose barb 28 of the filter cartridge 23, is quite short. More preferably, the coupling space is no greater than 6 inches. Even more preferably, the coupling space is no greater than 1 inch. Most preferably, the coupling space is 0.5 inches or less. To minimize leakage of the fountain solution, each of the hose barbs 42, 44 and 46 may be sealed with conventional hose clamps 50. Alternatively, the conduit 40 may be omitted and the first outlet 36 may be directly connected to the filter assembly 20. For example, the connector 28 of the filter assembly and first outlet 36 of the bypass valve 32 may be threaded to form a screw connection. In a further alternative, a pressure sensitive device such as a bypass valve may be integrated with either end cap of the filter cartridge 23.

In accordance with yet another aspect of the invention, differential pressure sensors (not shown) may be placed at various points along the recirculation assembly including in the return line 17 and in the conduit 40. The differential pressure indicators may be used as a check to ensure that the bypass valve 32 diverts the flow of the fountain solution when the pressure differential across the filter assembly is in the desired range. Sensors, such as magnetic switches, may also be utilized to sense the opening of the bypass valve and alert an operator to the fouling of the filter cartridge.

While several embodiments of the invention have been described in some detail, it should be understood that the invention encompasses various modifications and alternative forms of those embodiments. It should also be understood that the specific embodiments are not intended to limit the invention. Accordingly, the invention covers all other modifications, equivalents and alternatives falling within the spirit and scope of the claims.

We claim:

1. An apparatus for treating fountain solution for a printing system which includes at least one fountain solution tray having an outlet and an inlet, the apparatus comprising:

a recirculation assembly connectable between the outlet of the fountain solution tray and the inlet of the fountain solution tray of the printing system and operable to circulate fountain solution along a circulation path from the outlet of the fountain solution tray through the recirculation assembly to the inlet of the fountain solution tray of the printing system, the recirculation assembly including a fountain solution sump and a return line, the return line including a flexible conduit extending from the fountain solution tray of the printing system to the fountain solution sump of the recirculation assembly;

a microporous filter assembly disposed in the fountain solution sump of the recirculation assembly or in the return line between the outlet of the fountain solution tray of the printing system and the fountain solution sump of the recirculation assembly, the microporous filter assembly including a filter positioned across a fountain solution flow path; and a pressure sensitive device in fluid communication with the filter to bypass the filter in response to a predetermined pressure differential, said pressure sensitive device including a bypass valve having an inlet coupled to the flexible conduit, a first outlet coupled to the microporous filter assembly and a second outlet in fluid communication with the fountain solution sump, the second outlet being opened and closed responsive to a pressure differential between the inlet and the second outlet, the bypass valve and the filter assembly being free to float or sink beneath the surface of the fountain solution in the fountain solution sump.

2. The fountain solution treating apparatus of claim 1 wherein said microporous filter assembly includes a filter cartridge having a clean pressure drop equal to or less than about 0.10 PSI/GPM per ten inch cartridge.

3. The fountain solution treating apparatus of claim 1 wherein said microporous filter assembly includes a filter cartridge having a clean pressure drop equal to or less than about 0.03 PSI/GPM per ten inch cartridge.

4. The fountain solution treating apparatus of claim 1 wherein said microporous filter assembly includes a filter cartridge having a clean pressure drop equal to or less than about 0.03 PSI/GPM per ten inch cartridge and said microporous filter assembly includes a removal rating of at least about 99.98% at about 40μ.

5. The fountain solution treating apparatus of claim 1 wherein said microporous filter assembly includes a filter cartridge having a clean pressure drop equal to or less than about 0.03 PSI/GPM per ten inch cartridge and the filter includes a removal rating of at least about 99.98% at about 20μ.

6. The fountain solution treating apparatus of claim 1 wherein said microporous filter assembly includes a filter cartridge having a clean pressure drop equal to or less than about 0.10 PSI/GPM per ten inch cartridge and the filter includes a removal rating of at least about 99.98% at about 10μ.

7. The fountain solution treating apparatus of claim 1 wherein the filter element includes a removal rating of at least about 99.98% at about 40μ.

8. The fountain solution treating apparatus of claim 7 including a gravity feed for feeding the fountain solution from the fountain solution tray to the fountain solution sump.

9. The fountain solution treating apparatus of claim 1 wherein the filter element includes a removal rating of at least about 99.98% at about 20μ.

10. The fountain solution treating apparatus of claim 1 wherein the filter element includes a removal rating of at least about 99.98% at about 10μ.

11. The fountain solution treating apparatus of claim 1 wherein the fountain solution sump is arranged relative to the fountain solution tray such that the fountain solution is driven from the fountain solution tray to the fountain solution sump by a gravitational force.

12. The fountain solution treating apparatus of claim 1 including a gravity assisted feed for feeding the fountain solution from the fountain solution tray to the fountain solution sump.

13. An apparatus for treating fountain solution for a printing system which includes at least one fountain solution tray having an outlet and an inlet, the apparatus comprising:

a recirculation assembly connectable between the outlet of the fountain solution tray and the inlet of the fountain solution tray of the printing system and operable to circulate fountain solution along a circulation path from the outlet of the fountain solution tray through the recirculation assembly to the inlet of the fountain solution tray of the printing system, the recirculation;

a microporous filter assembly disposed in the fountain solution sump of the recirculation assembly or in the return line between the outlet of the fountain solution tray of the printing system and the fountain solution sump of the recirculation assembly, the microporous filter assembly including a filter element positioned across a fountain solution flow path, the filter element having a removal rating of at least about 99.98% at about 40μ and having a clean pressure drop equal to or less than about 0.10 PSI/GPM per ten-inch cartridge; and a pressure sensitive device in fluid communication with the filter to bypass the filter in response to a predetermined pressure differential.

14. The fountain solution treating apparatus of claim 13 wherein the pressure sensitive device includes a bypass valve having an inlet coupled to the return line, a first outlet coupled to the microporous filter assembly and a second outlet in fluid communication with the fountain solution sump, the second outlet being opened and closed responsive to a pressure differential between the inlet and the second outlet.

15. The fountain solution treating apparatus of claim 13 wherein said microporous filter assembly includes a filter cartridge having a clean pressure drop equal to or less than about 0.05 PSI/GPM per ten-inch cartridge.

16. The fountain solution treating apparatus of claim 13 wherein the filter element includes a removable rating of at least 99.98% at 20μ.

17. The fountain solution treating apparatus of claim 13 wherein the recirculation assembly includes a gravity feed that feeds the fountain solution from the fountain solution tray to the fountain solution sump at a feed pressure.

18. The fountain solution treating apparatus of claim 13 wherein the recirculation assembly includes a gravity assisted feed that feeds the fountain solution from the fountain solution tray to the fountain solution sump at a feed pressure.

19. An apparatus for treating fountain solution for a printing system which includes at least one fountain solution tray having an outlet and an inlet, the apparatus comprising:

a recirculation assembly connectable between the outlet of the fountain solution tray and the inlet of the fountain solution tray of the printing system and operable to circulate fountain solution along a circulation path from the outlet of the fountain solution tray through the recirculation assembly to the inlet of the fountain solution tray of the printing system, the recirculation assembly including a fountain solution sump and a return line extending from the fountain solution tray of the printing system to the fountain solution sump of the recirculation assembly;

a microporous filter assembly disposed in the fountain solution sump of the recirculation assembly or in the return line between the outlet of the fountain solution tray of the printing system and the fountain solution sump of the recirculation assembly, the microporous filter assembly including a cylindrical, pleated filter element positioned across a fountain solution flow path, the filter element including a laid-over pleat structure and the filter element having a removal rating of at least about 99.98% at about 40μ and a clean pressure drop of about 0.10 PSI/GPM per ten inch cartridge; and a pressure sensitive device in fluid communication with the filter to bypass the filter in response to a predetermined pressure differential.

20. The apparatus for treating fountain solution of claim 19 wherein the filter element includes a plurality of pleats, an inner periphery and an outer periphery, each of the plurality of pleats including a height H wherein the height H is greater than a distance between the inner and outer peripheries.

* * * * *